US008245396B2

(12) United States Patent
Kondo et al.

(10) Patent No.: US 8,245,396 B2
(45) Date of Patent: Aug. 21, 2012

(54) METHOD FOR CRIMPING TERMINAL TO ALUMINUM ELECTRIC WIRE

(75) Inventors: Takaya Kondo, Makinohara (JP); Tadahisa Sakaguchi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 32 days.

(21) Appl. No.: 12/809,220

(22) PCT Filed: Dec. 16, 2008

(86) PCT No.: PCT/JP2008/072893

§ 371 (c)(1),
(2), (4) Date: Jun. 18, 2010

(87) PCT Pub. No.: WO2009/081798

PCT Pub. Date: Jul. 2, 2009

(65) Prior Publication Data

US 2011/0225820 A1 Sep. 22, 2011

(30) Foreign Application Priority Data

Dec. 20, 2007 (JP) ..... 2007-328791

(51) Int. Cl.
*H01R 43/04* (2006.01)

(52) U.S. Cl. ..... 29/863; 29/861; 29/862; 174/84 R; 439/203

(58) Field of Classification Search ..... 29/861, 29/862, 863; 439/203; 174/84 R
See application file for complete search history.

(56) References Cited

U.S. PATENT DOCUMENTS

| | | | | | |
|---|---|---|---|---|---|
| 2,815,497 | A * | 12/1957 | Redslob | 439/203 |
| 3,895,851 | A * | 7/1975 | Bolton et al. | 439/387 |
| 3,912,358 | A * | 10/1975 | Miller et al. | 439/877 |
| 5,245,132 | A * | 9/1993 | Luetzow | 174/74 R |
| 5,849,424 | A * | 12/1998 | Sugawara et al. | 428/674 |
| 6,334,798 | B1 * | 1/2002 | Ushijima et al. | 439/879 |
| 6,942,529 | B2 * | 9/2005 | Fujimoto et al. | 439/886 |

FOREIGN PATENT DOCUMENTS

| | | | |
|---|---|---|---|
| JP | 55-114176 | U | 8/1980 |
| JP | 57-009172 | U | 1/1982 |
| JP | 64-009361 | U | 1/1989 |
| JP | 11-121075 | A | 4/1999 |
| JP | 2000-299140 | A | 10/2000 |
| JP | 2007-173215 | A | 7/2007 |

OTHER PUBLICATIONS

International Search Report (PCT/ISA/210) dated Jan. 20, 2009 in PCT/JP2008/072893.
Japanese Office Action dated Jul. 5, 2012 issued by the Japanese Patent Office in counterpart Japanese Patent Application No. 2007-328791.

* cited by examiner

*Primary Examiner* — Carl Arbes
(74) *Attorney, Agent, or Firm* — Sughrue Mion, PLLC

(57) ABSTRACT

In order to promote the adhesion of a crimp terminal (10) to an aluminum electric wire (100) by virtue of crimping to thereby realize an improvement in electric connecting performance, the thickness of tin plating applied to an inner surface of a conductor crimping portion (13) of the crimp terminal (10) is set to be in the range from 2.1 μm to 5.0 μm, and then, the conductor crimping portion (13) is crimped to a conductor (100*a*) of the aluminum electric wire (100).

8 Claims, 8 Drawing Sheets

METHOD FOR CRIMPING TERMINAL TO ALUMINUM ELECTRIC WIRE

TECHNICAL FIELD

The present invention relates to a method for crimping a terminal to an aluminum electric wire.

BACKGROUND ART

A crimping method is widely used as a method for connecting a terminal and an electric wire. Crimping means a technique in which a conductor exposed portion of an electric wire is inserted into a conductor crimping portion and the electric wire is electrically connected to the conductor crimping portion by crimping the conductor crimping portion with a crimp tool or the like so as to embrace the conductor exposed portion therein. The conductor crimping portion has a substantially U-shape and is provided on a terminal.

In order to improve the connecting performance by crimping, it is conventionally practiced to plate a surface of a terminal with tin to thereby increase the crimping performance. In the event that the terminal plated with tin in the way described above is crimped to an electric wire, it is known that the tin with which the terminal is plated acts an intermediary between a conductor of the electric wire and a base material of the terminal to thereby improve the connecting performance. It is also known that by changing the thickness of tin applied to the terminal depending on the location on the terminal, the wear of crimping dies is reduced or a terminal inserting force applied when fitting an electric connecting portion on a mating terminal is attempted to be reduced (refer to Patent Document 1).

Incidentally, it is general practice to use a copper electric wire for a wiring harness which is disposed in an interior of a vehicle such as a motor vehicle. Conventionally, an aluminum electric wire has been little used since the aluminum electric wire which is inferior to the copper electric wire in physical properties such as conductivity and strength has been difficult to be used. In recent years, however, demands for use of aluminum electric wires have been enhanced in consideration of reduction in weight of the vehicle for improvement in fuel economy and recycling capability.

In the event of an aluminum electric wire being used, since aluminum or an aluminum alloy which makes up a conductor of the electric wire is inferior to copper in mechanical strength and electricity conductivity, a further increase in connecting performance at a conductor crimping portion is needed. In addition, since an oxide coating having a high intrinsic resistance value is normally produced on a surface of the conductor of aluminum or an aluminum alloy, a sufficient contact for electric continuity must be realized between conductors (that is, the terminal and the aluminum or aluminum alloy conductor) by breaking the oxide coating in crimping the terminal to the aluminum electric wire. However, since aluminum electric wires have been little used, no sufficient study has been made in that field under the current circumstances.

Patent Document 1: Japanese Patent Publication No. 11-121075

DISCLOSURE OF THE INVENTION

Problem that the Invention is to Solve

Although the use of the tin plated terminal described above contributes to the increase in connecting performance also when crimping a terminal to an aluminum electric wire, sufficient increase in connecting performance has been unable to be expected with the conventional terminal crimping method.

The invention has been made in view of these situations, and an object thereof is to provide a method for crimping a terminal to an aluminum electric wire which can promote adhesion by crimping when an aluminum electric wire is used to thereby expect an increase in electric connecting performance.

Means for Solving the Problem (1) With a view to attaining the object, according to the invention, there is provided a method for crimping a terminal to an aluminum electric wire, including:

preparing a terminal having an electric connecting portion which is configured to be connected with a mating terminal at a front end side thereof, and a conductor crimping portion which is configured to crimped to a conductor of an electric wire configured to be connected therewith by bent inward to be crimped at a rear end side thereof, wherein at least an inner surface of the conductor crimping portion is plated with a metal whose hardness is lower than a hardness of a metal of a terminal base material, and a thickness of the metal applied to plate the inner surface is set to be in a range from 2.1 μm to 5.0 μm;

preparing an aluminum electric wire having a conductor made of aluminum or an aluminum alloy as the electric wire configured to be connected with the conductor crimping portion; and crimping the conductor crimping portion to the conductor of the aluminum electric wire by bending the conductor crimping portion inwards in a state that the conductor of the aluminum electric wire is inserted into an interior of the conductor crimping portion of the crimp terminal.

(2) It is preferred that the terminal base material of the crimp terminal prepared in the method set forth under (1) is made of copper or a copper alloy and that the metal with which the terminal base material is plated is tin.

(3) It is preferred that the conductor crimping portion of the crimp terminal prepared in the method set forth under (1) has a bottom plate part and a pair of conductor crimping pieces which extend upwards from both side edges of the bottom plate part and which are configured to be bent inwards so as to embrace the conductor of the aluminum electric wire to thereby crimp the conductor so as to be in close contact with an upper surface of the bottom plate part. The conductor crimping portion may be formed to have a substantially U-shaped section. In the crimping, the pair of conductor crimping pieces may be bent inwards so as to be crimped to the conductor in such a state that the conductor is placed on the bottom plate part of the crimp terminal.

According to the method of the invention, since the thickness of the metal applied to plate the inner surface of the conductor crimping portion is set to be in the range from 2.1 μm to 5.0 μm, the adhesion between the metal with which the base material of the terminal is plated and the conductor of the aluminum electric wire can be increased, thereby making it possible to stabilize the electric connection therebetween. In particular, since the metal with which the base material of the terminal is plated fills gaps defined between individual strands which make up the conductor of the aluminum electric wire while adhering to surfaces of the strands, contact areas between the strands and between the strands and the crimp terminal can be increased, thereby making it possible to realize a reduction in contact resistance. In addition, since a new surface of the metal with which the base material of the terminal is plated is caused to adhere to the conductor of the aluminum electric wire by virtue of plastic deformation at the time of crimping, a gastight construction can be obtained to thereby increase the contact reliability.

In addition, as is described under (2) above, when using the crimp terminal which is plated with tin whose hardness is lower than that of copper or the copper alloy which is used as base material of the terminal, an increase in electric connecting performance is preferably realized while ensuring the required mechanical strength.

Further, as is described under (3) above, when the conductor crimping portion is crimped to the conductor of the aluminum electric wire by placing the conductor of the aluminum electric wire on the bottom plate part and bending the pair of conductor crimping pieces in that state so as to embrace the conductor therein to thereby crimp the conductor, a highly reliable and stable crimped connecting portion can preferably be obtained.

Advantage of the Invention

According to the invention, since the thickness of the metal applied to plate the inner surface of the conductor crimping portion of the crimp terminal which is brought into contact with the conductor of the aluminum electric wire is set to be in the range from 2.1 μm to 5.0 μm, the adhesion between the crimp terminal and the conductor of the aluminum electric wire can be promoted, thereby making it possible to improve reliability of electric connection of the crimp terminal with the aluminum electric wire.

Thus, the invention has been briefly described. Further, by perusing a best mode for carrying out the invention which will be described hereinbelow while referring to accompanying drawings, the details of the invention will be made clearer.

DESCRIPTION OF REFERENCE NUMERALS

Figure 1:
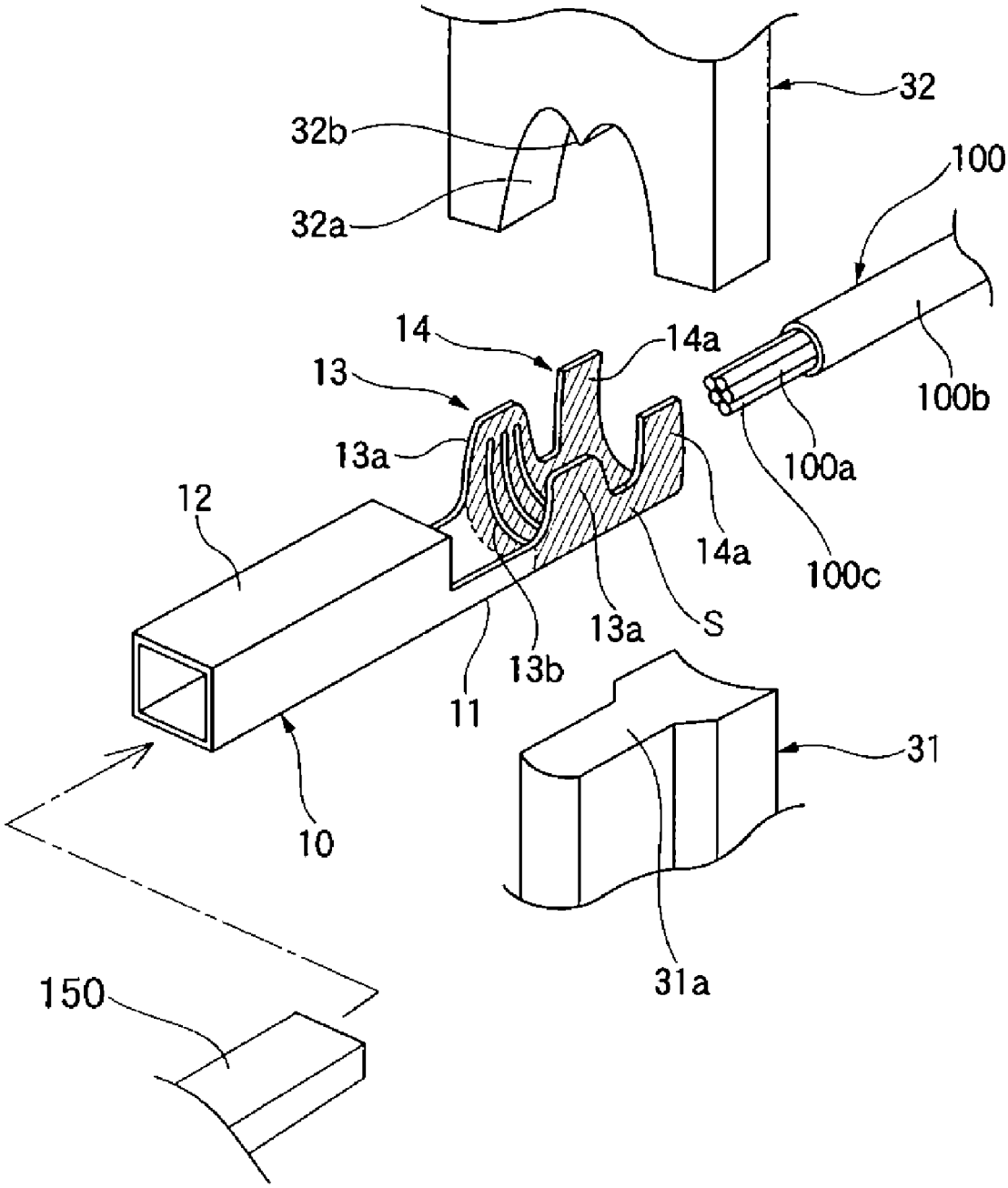
[FIG. 1] An explanatory drawing of a crimping method for crimping a crimp terminal to an aluminum electric wire according to an embodiment of the invention.

10: crimp terminal
11: bottom portion
12: electric connecting portion
13: conductor crimping portion
13*a*: conductor crimping piece
51: terminal base material
52: tin plating
100: aluminum electric wire
100*a*: aluminum conductor

BEST MODE FOR CARRYING OUT THE INVENTION

Hereinafter, a preferred embodiment according to the invention will be described in detail based on the drawings.

In FIG. 1, reference numeral 10 denotes a crimp terminal, reference numeral 100 denotes an aluminum electric wire, and reference numerals 31 and 32 denote a lower die and an upper die of a crimping jig, respectively. In this embodiment, the crimp terminal 10 is used in which a tin plating 52 is applied to a surface of a terminal base material 51 (refer to FIG. 5) of copper or a copper alloy in order to increase an electric connecting performance thereof. In addition, an aluminum electric wire 100 is such that an aluminum conductor 100*a* made up of a bundle of strands 100*c* which can take the form of twisted strands is held at a center of an insulation sheathing 100*b*.

The crimp terminal 10 includes an electric connecting portion 12 for electric connection with a mating terminal 150 (refer to FIG. 1) at a front end side in a longitudinal direction thereof (hereinafter, this direction is referred to as a "front-rear direction" and a direction which is at right angles to the front-rear direction is referred to as a "left-right direction."). In addition, the crimp terminal 10 includes a conductor crimping portion 13 which is crimped to an exposed conductor (namely, an aluminum conductor exposed from the insulating sheathing 100*b*) 100*a* at a leading end portion of the aluminum electric wire 100 and a sheathing crimping portion 14 which is crimped to a portion of the aluminum electric wire 100 which has the sheathing 100*b* at a rear end side in the front-rear direction. The electric connecting portion 12, the conductor crimping portion 13 and the sheathing crimping portion 14 are configured so as to include a common bottom plate part 11.

The conductor crimping portion 13 is a portion having a substantially U-shaped section where a pair of conductor crimping pieces 13*a* are formed on both side edges in the left-right direction of the bottom plate part 11 which is continued from the electric connecting portion 12 so as to be erected therefrom. A plurality of serrations (namely, shallow grooves formed linearly by a press) 13*b* are provided on an inner surface of the conductor crimping portion 13 so as to extend in the left-right direction of the crimp terminal 10. In addition, the sheathing crimping portion 14 is a portion having a substantially U-shaped section where a pair of sheathing crimping pieces 14*a* are formed on both the side edges in the left-right direction of the bottom plate part 11 so as to be erected therefrom. The conductor crimping portion 13 and the sheathing crimping portion 14 are disposed in the front-rear direction with an appropriate interval provided therebetween.

Figure 5:
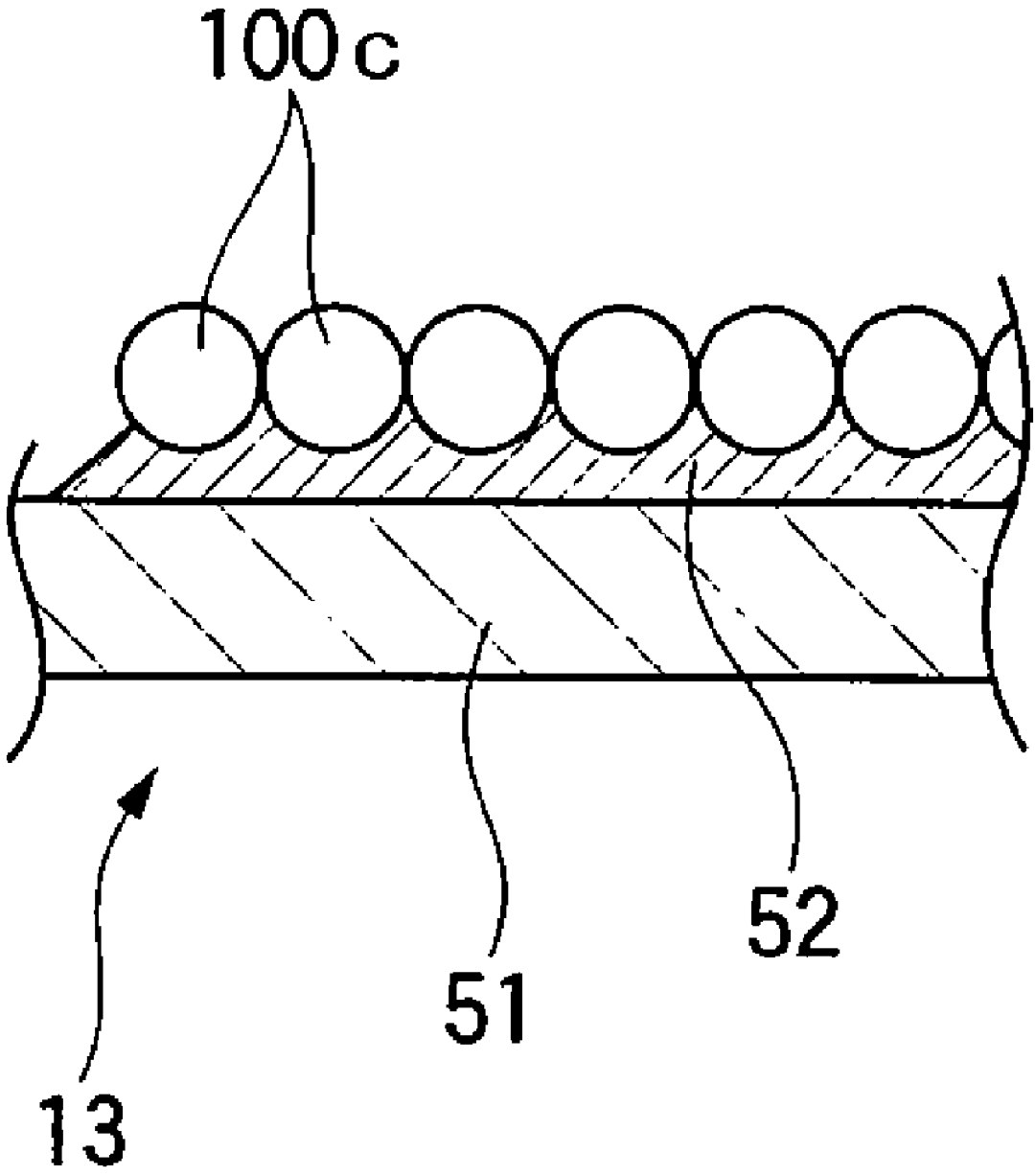
[FIG. 5] A sectional view showing exemplarily a state in which tin with which the terminal is plated enters gaps defined between strands which make up the conductor of the aluminum electric wire at the conductor crimping portion.

Referring to FIG. 5, the tin plating 52 is applied thin at the electric connecting portion 12 lying at the front end side of the crimp terminal 10, while the tin plating 52 is applied thick at the conductor crimping portion 13 and the sheathing crimping portion 14 which lie at the rear end side of the crimp terminal 10. In FIG. 1, the portion where the plating is applied thick is shaded with sloping lines S. In particular, the thickness of the tin plating 52 is set to be in the range from 2.1 μm to 5.0 μm on an inner surface of the conductor crimping portion 13 which is a portion which is brought into contact with the aluminum conductor 100*a* when the conductor crimping pieces 13*a* are crimped. In addition, since in case the thickness of the tin plating 52 is made too thick at the electric connecting portion 12, there is a fear that the electric contact performance is deteriorated, the thickness of the tin plating 52 is set to be 5.0 μm or smaller which is the general thickness.

Figure 2:
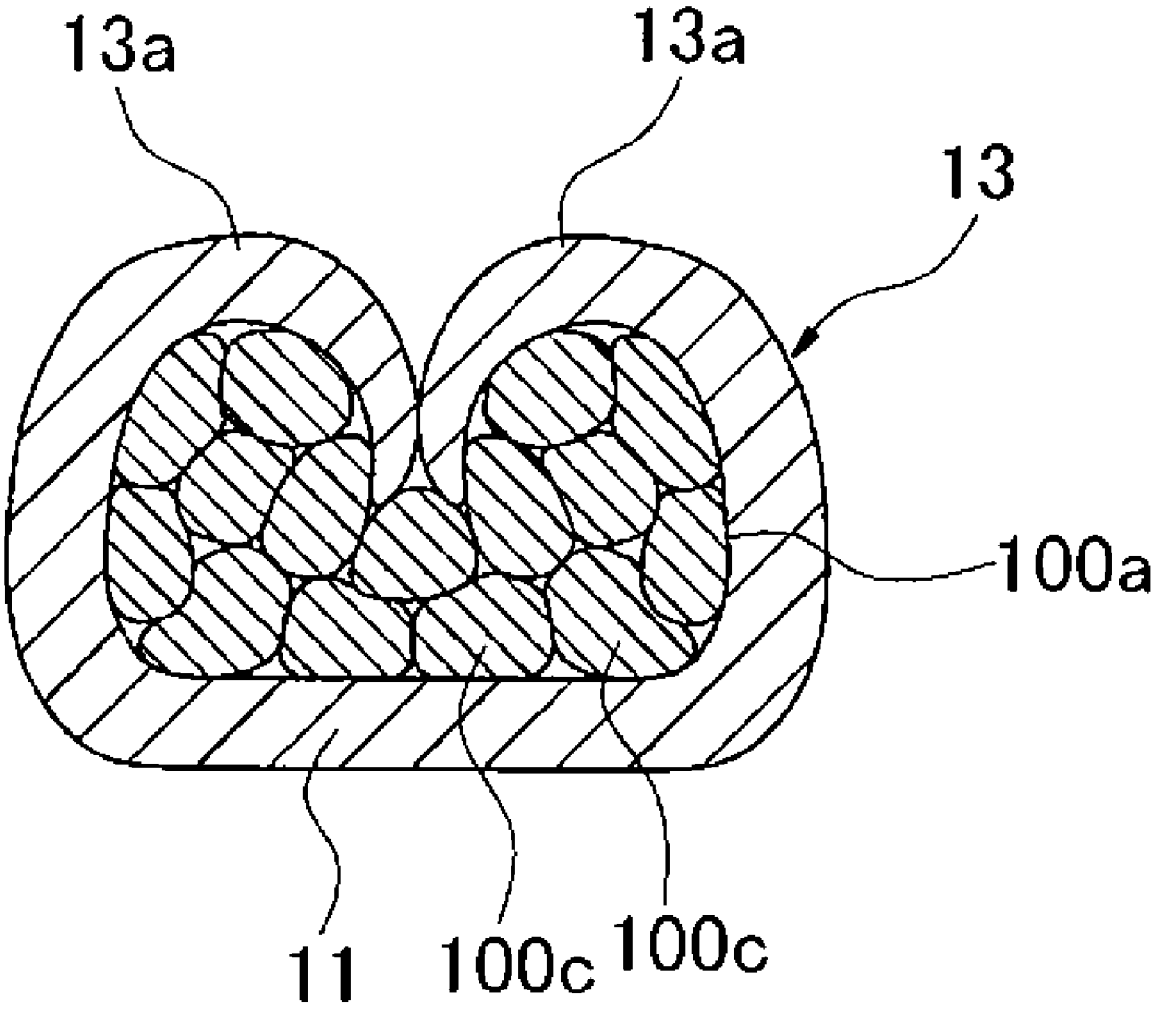
[FIG. 2] A sectional view of a conductor crimping portion of the crimp terminal in such a state that the conductor crimping portion is crimped to the aluminum electric wire.

When crimping the crimp terminal 10 which is configured as described above to the exposed conductor 100*a* at the leading end portion of the aluminum electric wire 100, firstly, the crimp terminal 10 is placed on a placing surface 31*a* of a lower die 31 and the exposed conductor 100*a* at the leading end portion of the aluminum electric wire 100 is inserted between the conductor crimping pieces 13*a* of the conductor crimping portion 13 and is placed on the bottom plate part 11. Then, an upper die 32 is lowered in that state, whereby leading end sides of the conductor crimping pieces 13*a* are caused to fall inwards gradually by guiding sloping surfaces 32*a* of the upper die 32. Further, finally, leading ends of the conductor crimping pieces 13*a* are rounded so as to be bent back towards the aluminum conductor 100*a* side by curved surfaces which stretch from the guiding sloping surfaces 32*a* to a central angled portion 32*b*, and as is shown in FIG. 2, the leading ends are caused to bite into the aluminum conductor 100*a* while rubbing against each other, whereby the conductor crimping pieces 13*a* are crimped so as to embrace the aluminum conductor 100*a* therein. As to the sheathing crimping portion 14, prior to the crimping of the conductor crimping portion 13, the sheathing crimping pieces 14*a* are crimped in advance to the portion of the aluminum electric wire 100 which has the sheathing portion 100*b* in the way described above.

When the conductor crimping portion 13 is crimped to the aluminum conductor 100*a* of the aluminum electric wire 100 by crimping the conductor crimping pieces 13*a*, the conductive metal which makes up the crimp terminal 10 can be caused to adhere (can be joined at a molecular or atomic level) to the aluminum conductor 100*a* of the aluminum electric wire 100, thereby making it possible to join the crimp terminal 10 to the aluminum electric wire 100 electrically and mechanically strong.

Figure 4:
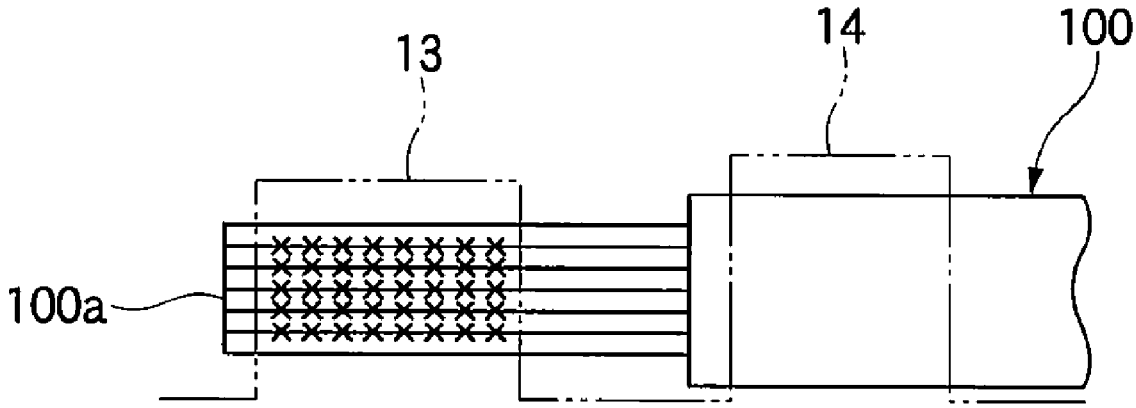
[FIG. 4] A schematic perspective view which explains a relationship between the conductor crimping portion and a conductor of the aluminum electric wire.

Namely, since the thickness of plating applied to the inner surface of the conductor crimping portion 13 of the crimp terminal 10 is set thicker so as to fall in the range from 2.1 μm to 5.0 μm, as is shown in FIGS. 4 and 5, the adhesion of tin which is applied to the terminal base material 51 to the aluminum conductor 100*a* of the aluminum electric wire 100 can be increased, thereby making it possible to realize stabilization in electric connection. In particular, as is shown in FIG. 5, since tin in the tin plating 52 applied to the terminal base material 51 fills gaps between the individual strands 100*c* which make up the aluminum conductor 100*a* while adhering to the surfaces of the strands 100*c* by virtue of crimping, contact areas between the strands 100*c* and between the strands 100*c* and the terminal can be increased, thereby making it possible to realize a reduction in contact resistance. In addition, since a new metal surface of the tin plating 52 on the terminal base material 51 is caused to adhere to the aluminum conductor 100*a* by virtue of plastic deformation occurring at the time of crimping, a gastight construction can be obtained, thereby the contact reliability therebetween being increased. In this case, in the event that the thickness of tin plating on the inner surface of the conductor crimping portion 13 is less than 2.1 μm, there is a fear that the adhesion to the aluminum conductor 100*a* becomes insufficient, whereas in the event that the plating thickness exceeds 5.0 μm, there is caused a problem that the conductor crimping portion 13 becomes difficult to be worked.

Figure 3:
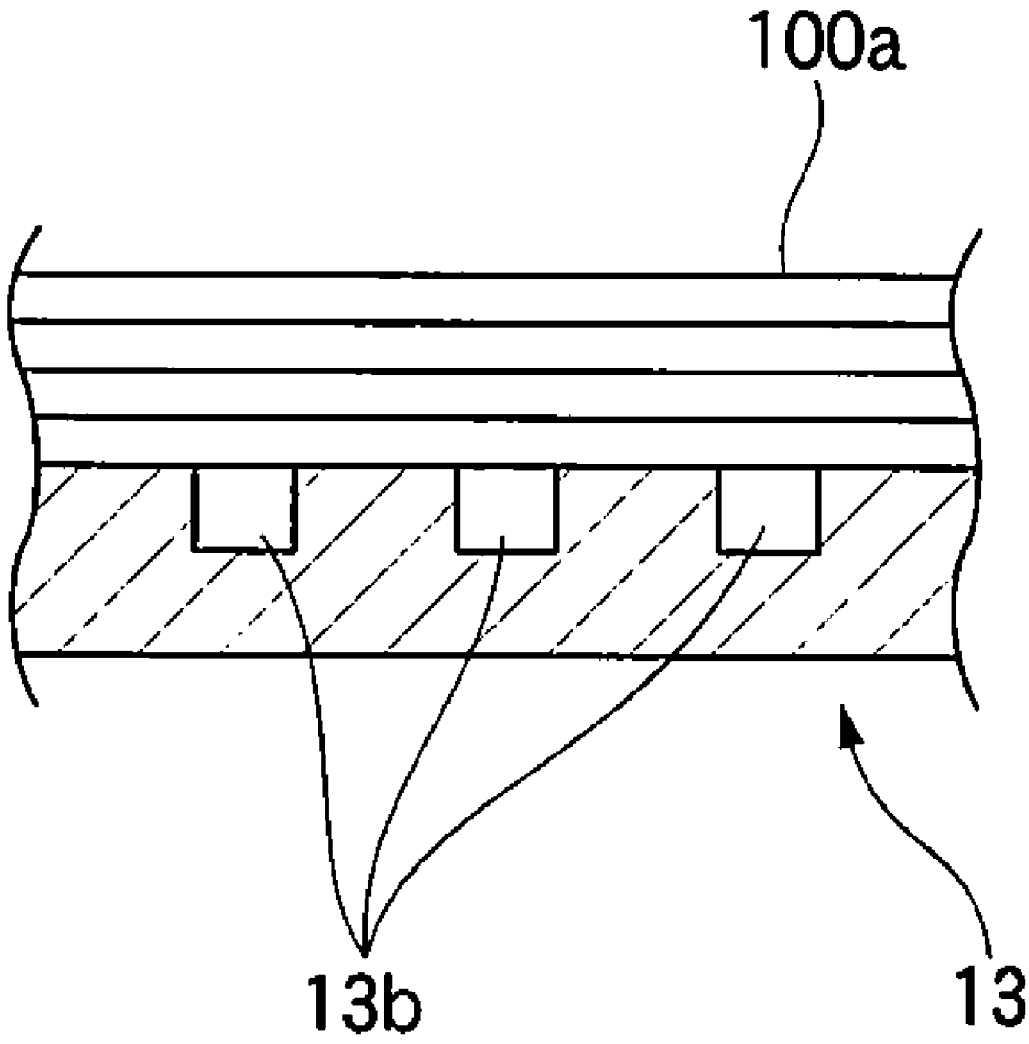
[FIG. 3] A longitudinal sectional view of a portion of the conductor crimping portion where serrations are provided.

In addition, as is shown in FIG. 3, in the event that the serrations 13*b* are provided on the inner surface of the conductor crimping portion 13, the tin plating 52 (refer to FIG. 5) is deformed by crimping to be caused to adhere to the aluminum conductor 100*a* while entering the serrations 13*b*. Therefore, the joint strength of the crimp terminal 100 with respect to an axial direction of the aluminum electric wire 100 is increased.

Next, methods will briefly be described for plating thick the rear end side (that is, the portion where the conductor crimping portion 13 exists) of the crimp terminal 10 only.

Figure 6:
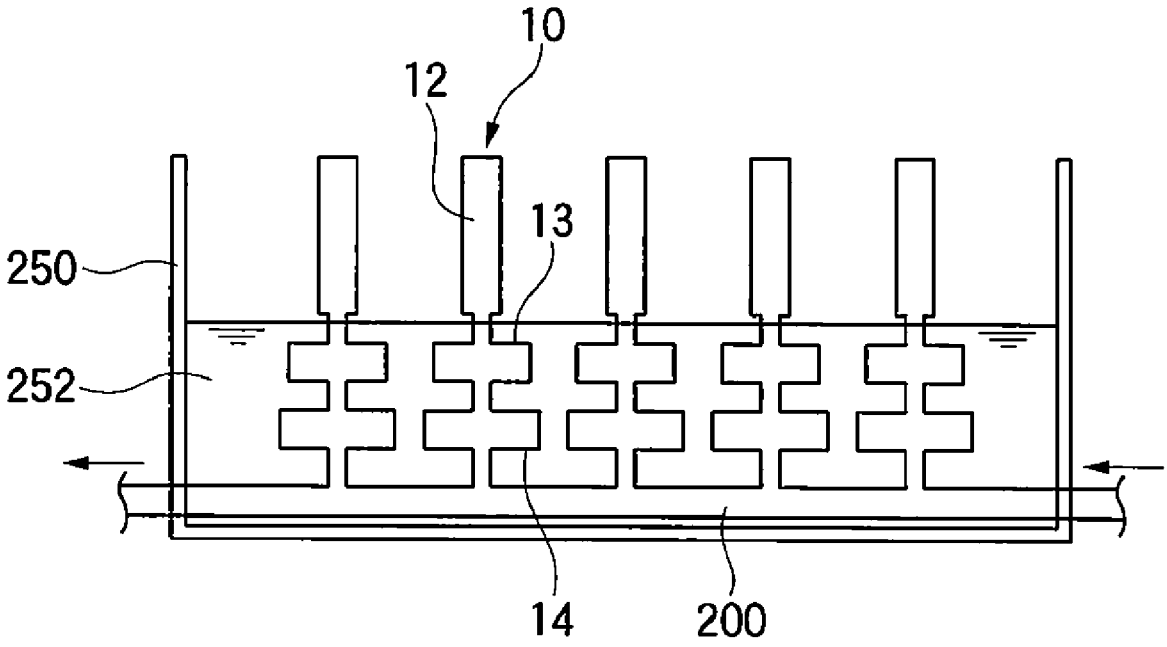
[FIG. 6] An explanatory drawing of a method for selectively increasing a plating thickness.

FIG. 6 is an explanatory drawing of a first method. In this method, plating is carried out while moving crimp terminals 10 horizontally with front end sides (that is, portions where electric contact portions 12 exist) of the crimp terminals 10 which are connected to a support 200 resulting after pressing exposed above a plating liquid 252 in a plating bath 250 and rear end sides (that is, portions where conductor crimping portions 13 and conductor crimping portions 14 exist) of the crimp terminals 10 submerged in the plating liquid 252. By implementing plating selectively in the way described above, only the rear end sides of the crimp terminals 10 which include the conductor crimping portions 13 can be plated thick.

Figure 7:
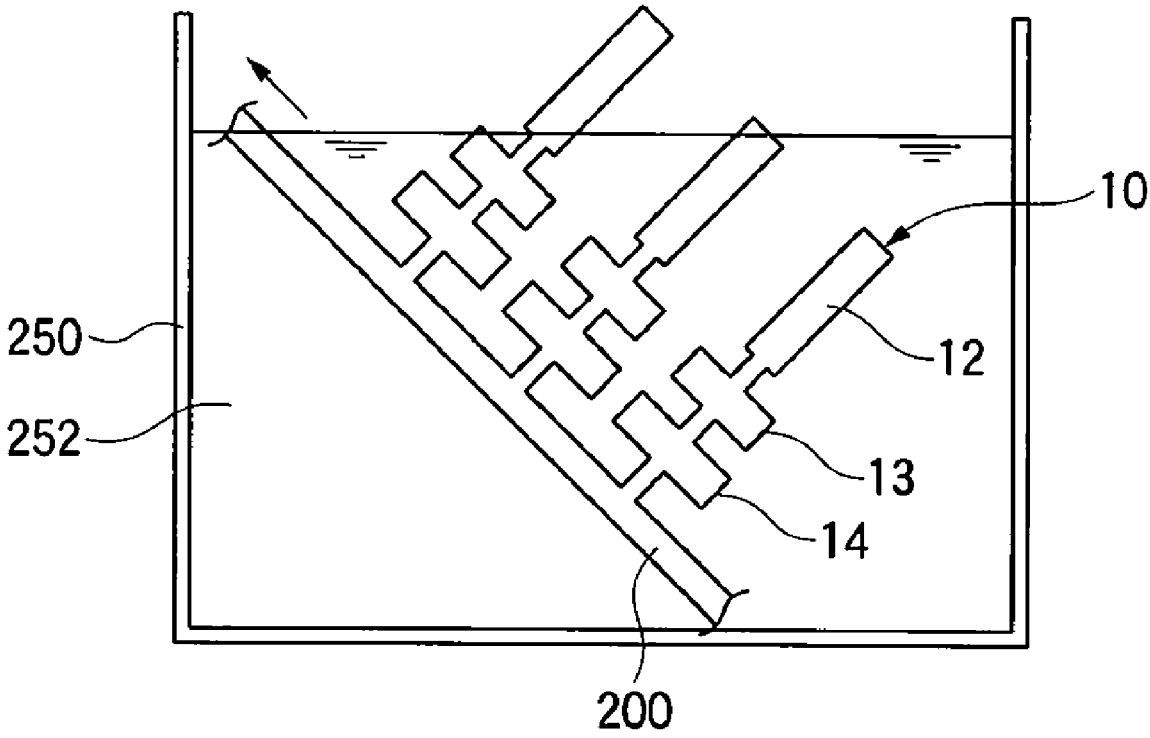
[FIG. 7] An explanatory drawing of another method for selectively increasing a plating thickness.

FIG. 7 is an explanatory drawing of a second method. In this method, crimp terminals 10 connected to a support 200 resulting after pressing are passed through a plating liquid 252 while moving them obliquely from inside to outside of the liquid 252 in a posture in which front end sides (that is, portions where electric contact portions 12 exist) of the crimp terminals 10 are oriented upwards and rear end sides (that is, portions where conductor crimping portions 13 and conductor crimping portions 14 exist) of the crimp terminals 10 are oriented downwards. When the crimp terminals 10 are moved obliquely in the way described above, a time when the rear end sides of the crimp terminals 10 stay in the plating liquid 252 becomes longer than a time when the front end sides of the crimp terminals 10 stay in the plating liquid 252. Consequently, the plating thickness at the portion which stays longer in the plating liquid 252 is increased, whereas the plating thickness of the portion which stays shorter in the plating liquid 252 is decreased, whereby only the rear end sides of the crimp terminals 10 where the conductor crimping portions 13 are included can be plated thick.

Figure 8:
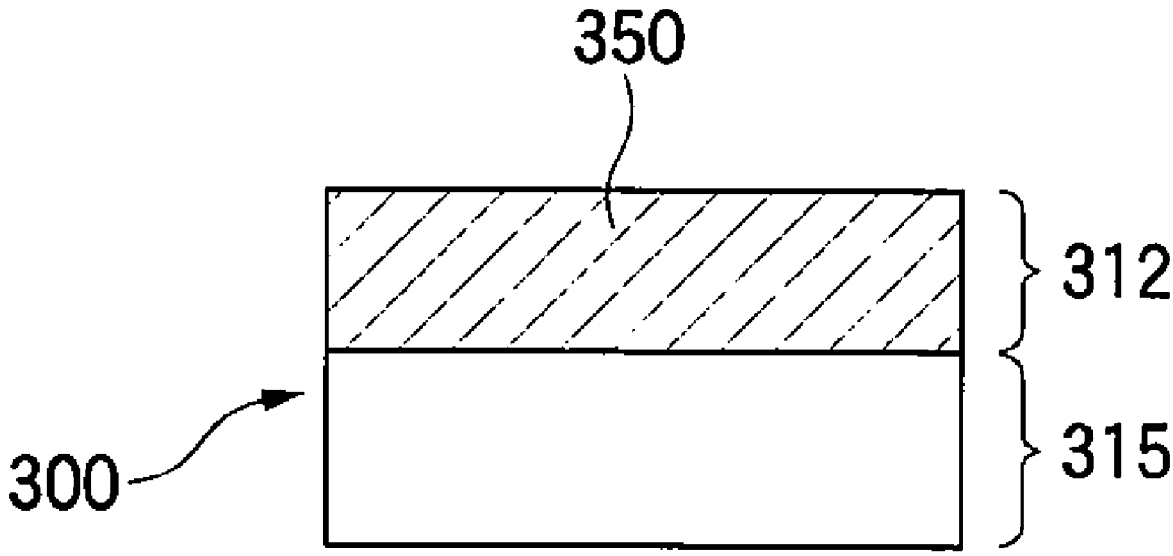
[FIG. 8] An explanatory drawing of a further method for selectively increasing a plating thickness.

FIG. 8 is an explanatory drawing of a third embodiment. In this method, in a stage of raw material 300 before crimp terminals are pressed, a front end side portion 312 which constitutes an electric contact portion is discriminated from a rear end side portion 315 which constitutes a conductor crimping portion and a sheathing crimping portion. Then, a masking 350 is applied to an area corresponding to the portion 312, so that only an area corresponding to the portion 315 is selectively plated. Then, electric contact portions, conductor crimping portions and sheathing crimping portions are pressed after plating, so that crimp terminals can be obtained in which the plating thickness is increased only at the rear end sides thereof.

In the event that plating is carried out with the masking 350 applied in the way described above, since only one side of the raw material 300 can be plated, the plating thickness can be increased only on the inner thickness of the conductor crimping portion of the crimp terminal.

Note that the invention is not limited to the embodiment described above and hence can be modified or improved as required. In addition, the materials, shapes, dimensions, numbers, and locations of the respective constituent elements are arbitrary and not limited as long as they are good enough to attain the invention.

For example, the conductor 100*a* of the aluminum electric wire 100 may be made of an aluminum alloy. As a specific example of an aluminum alloy, an alloy of aluminum and iron can be raised. In the case of this alloy being used, compared with the aluminum conductor, a resultant conductor becomes easy to be extended and the strength (particularly, a tensile strength) thereof can be increased.

The subject patent application is based on Japanese Patent Application (No. 2007-328791) filed on Dec. 20, 2007, the contents of which are to be incorporated herein by reference.

Industrial Applicability

According to the terminal crimping method for crimping a terminal to an aluminum electric wire of the invention, since the thickness of plating applied to the inner surface of the conductor crimping portion of the crimp terminal which is brought into contact with the conductor of the aluminum electric wire is set to fall in the range from 2.1 μm to 5.0 μm, the adhesion between the crimp terminal and the conductor of the aluminum electric wire can be promoted, thereby making it possible to realize an improvement in reliability in electric connection between the crimp terminal and the aluminum electric wire.

The invention claimed is:

1. A method for crimping a terminal to an aluminum electric wire, comprising:

preparing a terminal having an electric connecting portion which is configured to be connected with a mating terminal at a front end side thereof, and a conductor crimping portion which is configured to crimped to a conductor of an electric wire configured to be connected therewith by bent inward to be crimped at a rear end side thereof, wherein at least an inner surface of the conductor crimping portion is plated with a metal whose hardness is lower than a hardness of a metal of a terminal base material;

preparing an aluminum electric wire having a conductor made of aluminum or an aluminum alloy as the electric wire configured to be connected with the conductor crimping portion; and crimping the conductor crimping portion to the conductor of the aluminum electric wire by bending the conductor crimping portion inwards in a state that the conductor of the aluminum electric wire is inserted into an interior of the conductor crimping portion of the crimp terminal, wherein a thickness of the metal applied to plate the inner surface of the conductor crimping portion is thicker than a thickness of the metal applied to plate an inner surface of the electric connecting portion, and wherein the thickness of the metal applied to plate the inner surface of the conductor crimping portion is set to be in a range from 2.1 μm to 5.0 μm.

2. The method for crimping the terminal to the aluminum electric wire as set forth in claim 1, wherein the terminal base material is made of copper or a copper alloy, and a metal with which the terminal base material is plated is tin.

3. The method for crimping the terminal to the aluminum electric wire as set forth in claim 1, wherein the conductor crimping portion of the crimp terminal has a bottom plate part and a pair of conductor crimping pieces which extend upwards from both side edges of the bottom plate part and which are configured to be bent inwards so as to embrace the conductor of the aluminum electric wire to thereby crimp the conductor so as to be in close contact with an upper surface of the bottom plate part, the conductor crimping portion is formed to have a substantially U-shaped section, and in the crimping, the pair of conductor crimping pieces are bent inwards so as to be crimped to the conductor in such a state that the conductor is placed on the bottom plate part of the crimp terminal.

4. The method for crimping the terminal to the aluminum electric wire as set forth in claim 2, wherein the conductor crimping portion of the crimp terminal has a bottom plate part and a pair of conductor crimping pieces which extend upwards from both side edges of the bottom plate part and which are configured to be bent inwards so as to embrace the conductor of the aluminum electric wire to thereby crimp the conductor so as to be in close contact with an upper surface of the bottom plate part, the conductor crimping portion is formed to have a substantially U-shaped section, and in the crimping, the pair of conductor crimping pieces are bent inwards so as to be crimped to the conductor in such a state that the conductor is placed on the bottom plate part of the crimp terminal.

5. The method for crimping the terminal to the aluminum electric as set forth in claim 1, wherein the preparing of the terminal includes:

submerging the conductor crimping portion in a plating liquid while exposing the electric connecting portion above the plating liquid; and moving the terminal horizontally in a state where the conductor crimping portion is submerged in the plating liquid.

6. The method for crimping the terminal to the aluminum electric wire as set forth in claim 1, wherein the preparing of the terminal includes:

submerging the terminal in a plating liquid in a state where the electric connecting portion is oriented upwards and the conductor crimping portion is oriented downwards; and moving the terminal obliquely from inside to outside of the plating liquid so that a time when the conductor crimping portion stays in the plating liquid is longer than a time when the electric connecting portion stays in the plating liquid.

7. The method for crimping the terminal to the aluminum electric wire as set forth in claim 1, wherein the preparing of the terminal includes:

applying a masking on the conductor crimping portion; and plating the terminal in a state where the masking is applied on the conductor crimping portion.

8. The method for crimping the terminal to the aluminum electric wire as set forth in claim 1, wherein the inner surface of the conductor crimping portion includes serrations extending in the left-right direction of the terminal, and the metal enters into the serrations by the crimping.

* * * * *